United States Patent [19]

Sommer et al.

[11] Patent Number: 4,899,687

[45] Date of Patent: Feb. 13, 1990

[54] DEVICE FOR COATING A WEB OF MATERIAL TRAVELING AROUND A BACKING ROLLER

[75] Inventors: Herbert Sommer; Peter Rieleit, both of Dusseldorf, Fed. Rep. of Germany

[73] Assignee: Jagenberg Aktiengesellschaft, Dusseldorf, Fed. Rep. of Germany

[21] Appl. No.: 239,481

[22] Filed: Sep. 1, 1988

[30] Foreign Application Priority Data

Sep. 4, 1987 [DE] Fed. Rep. of Germany ..... 3729621

[51] Int. Cl.[4] ..... B05C 1/04; B05C 11/04

[52] U.S. Cl. ..... 118/126

[58] Field of Search ..... 118/100, 126, 107, 123, 118/121; 101/157

[56] References Cited

U.S. PATENT DOCUMENTS

| | | | |
|---|---|---|---|
| 2,352,337 | 6/1944 | Meyer | 101/157 |
| 2,920,557 | 1/1960 | Fuchs | 101/157 |
| 3,255,038 | 6/1966 | Coghill | 118/126 |
| 3,389,655 | 6/1968 | Lorenz et al. | 101/157 |
| 3,453,137 | 7/1969 | Penkala | 118/126 |
| 3,688,336 | 9/1972 | Costello et al. | 118/126 |
| 3,882,817 | 5/1975 | Zink | 118/126 |
| 4,375,202 | 3/1983 | Miller | 118/126 |
| 4,780,336 | 10/1988 | Damrau | 118/126 |

*Primary Examiner*—Willard Hoag

*Attorney, Agent, or Firm*—Sprung Horn Kramer & Woods

[57] ABSTRACT

A device for coating a web of material traveling around a backing roller, with a flexible doctor having a foot secured in a clamping beam and a point supported by a supporting strip and with pressure-adjusting mechanisms positioned above the width of the doctor and acting independently of each other on individual points on the doctor. The pressure-adjusting mechanisms below the supporting strip act on the doctor. In another embodiment, the pressure-adjusting mechanisms consist of several adjacent chambers that extend over the operating width and can be independently pressurized, each with an elastic wall that faces the doctor.

11 Claims, 3 Drawing Sheets

DEVICE FOR COATING A WEB OF MATERIAL TRAVELING AROUND A BACKING ROLLER

BACKGROUND OF THE INVENTION

The invention concerns a device for coating a web of material traveling around a backing roller, with a flexible doctor having a foot secured in a clamping beam and a point supported by a supporting strip and with pressure-adjusting mechanisms positioned above the width of the doctor and acting independently of each other on individual points on the doctor. Devices of this kind are employed in particular to coat paper and cardboard.

They have a coating-application system with rollers or nozzles that apply a surplus of coating to the web. Downstream of the coating-application system is a doctor that reduces the coating to the desired thickness. The quality of the coating is decisively affected by the geometry of the area of the doctor that rests against the backing roller. The coating density is established by the pressure of the doctor against the backing roller, which is dictated by the tension on the doctor. To prevent sacrificing coating quality, one version of the method of applying pressure demands that the geometry of the point of the doctor be kept essentially constant.

When webs of paper or cardboard are coated, production-dictated fluctuations in the transverse cross-section of the web occur and make it necessary to vary the pressure of the doctor locally at various points along the operating width in order to obtain a uniform coating. The supporting strip in the generic device disclosed in German Pat. No. 2 825 907 is to a certain extent flexible and can be adjusted for this purpose by tension and compression screws along its line of support depending on whether the coating density is too high or too low at the point in question.

This known coating device has two serious drawbacks. First, local correction of the coating density along the operating width by means of the pressure of the doctor is impossible without simultaneously varying the geometry of the point of the doctor. This can result in local and temporary variations in quality and in a delay in the initiation of the desired effect. Second, it is impossible to automatically control the local distribution of pressure while the web is being coated.

OBJECT OF THE INVENTION

The object of the invention is to improve the generic device and eliminate these drawbacks.

SUMMARY OF THE INVENTION

This object is attained in accordance with the invention by the improvement wherein the pressure-adjusting mechanisms below the supporting strip act on the doctor. The transverse cross-section can accordingly be automatically corrected while the web is being coated independently of the particular tension established before the beginning of the operation. Another advantage is that the tension, which determines the line of support can be left unchanged, with the result that the geometry of the point of the doctor will hardly change at all while the cross-section is being corrected.

The device can have a clamping beam that is flexible across the web of material and is subject to pressure-adjusting mechanisms that are separated along the operating width and can be activated independently. The device can have pressure-adjusting mechanisms in the form of spindle-based thrusters. The pressure-adjusting mechanisms can be separately engaged in order to establish the tension on the doctor. The doctor can be secured in the clamping beam in such a way that it can be moved toward the backing roller, and the position of individual areas of the doctor can be adjusted independently in relation to the clamping beam by means integrated into the clamping beam. The doctor can be secured in the clamping beam between a flexible strip that extends over the operating width and a resilient tensioning element, whereby pressure-adjusting mechanisms in the form of pneumatic or hydraulic mechanisms engage the flexible strip. The tensioning element can be a hose that extends over the operating width and can be charged with air.

The transverse cross-section is accordingly corrected in this embodiment by adjusting the foot of the doctor in the clamping beam and accordingly at a maximal distance from the supporting strip, and the geometry of the point of the doctor does not change while the cross-section is being corrected.

The pressure-adjusting mechanisms in another embodiment of the invention can consist of several adjacent chambers that extend over the operating width and can be independently pressurized, each with an elastic wall that faces the doctor.

This embodiment can have a resilient compensation strip that rests against the doctor with the elastic wall of the pressurized chambers resting against the surface that faces away from the doctor.

The elastic walls in this embodiment can rest against a supporting strip that constitutes the resilient compensation strip.

Each pressurized chamber in this embodiment can have a compressed-air supply line with an independently controlled valve that communicates with a joint distribution line that has its own pressure-regulation unit.

The cross-section can accordingly be corrected automatically in this embodiment.

BRIEF DESCRIPTION OF THE DRAWINGS

The invention will now be specified with reference to the drawings, wherein.

DETAILED DESCRIPTION OF THE INVENTION

Figure 1:
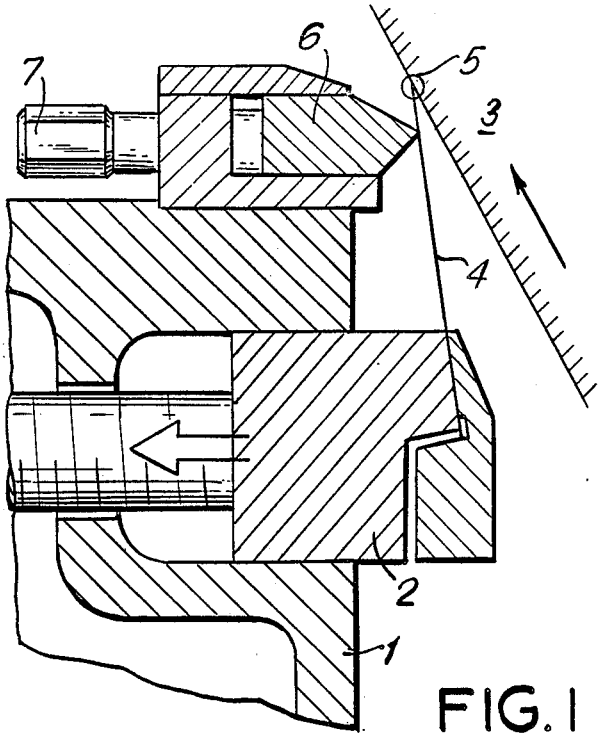
FIG. 1 is a section along the direction that the web travels in through a device with a flexible and locally adjustable clamping beam.
Figure 2:
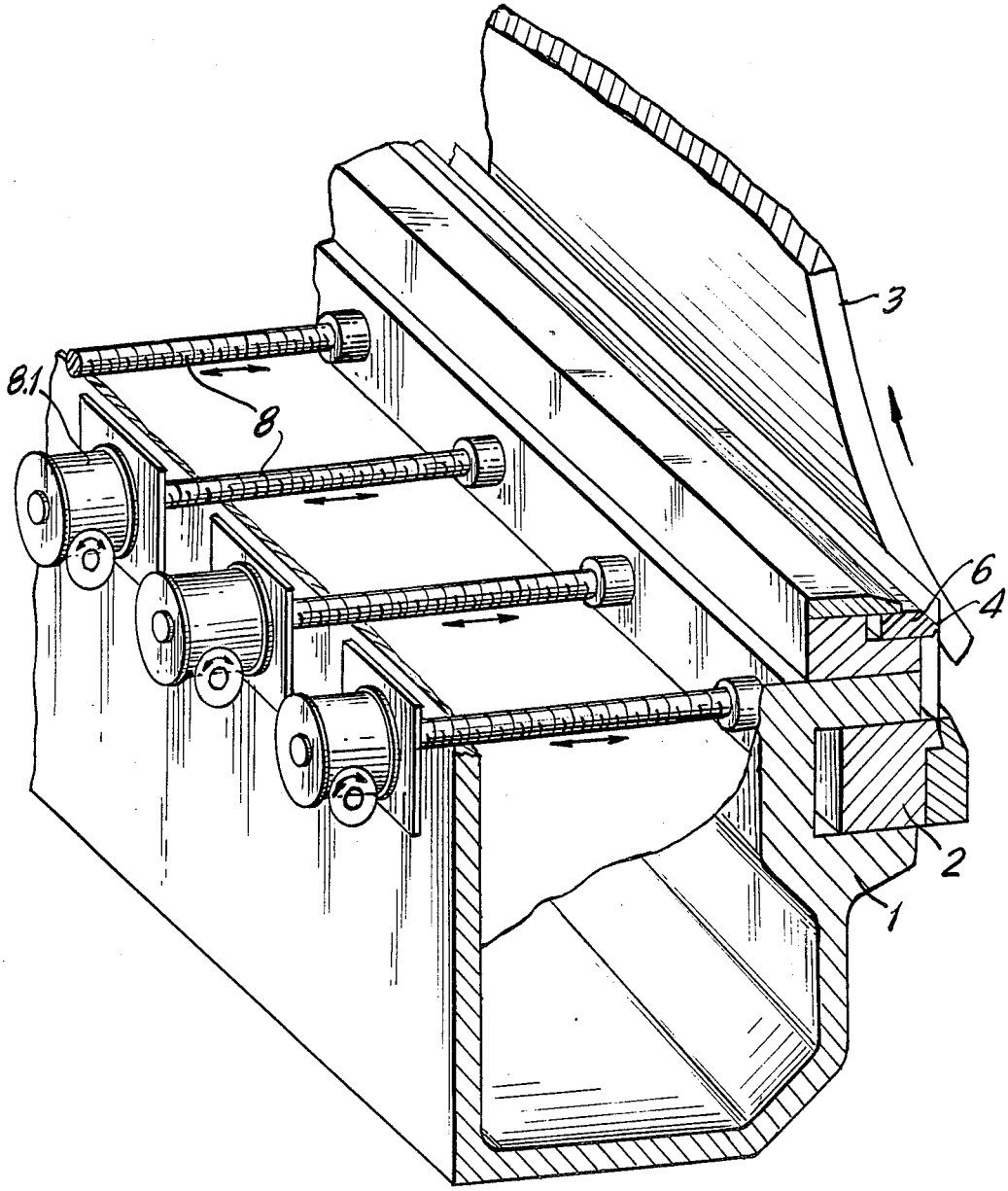
FIG. 2 is a perspective view across the web illustrated in FIG. 1.

With reference now to FIGS. 1 and 2, the embodiment includes a flow-control system consisting of a pivoting doctor beam 1, in which a clamping beam 2 that is flexible across the web is mounted in such a way that it can be shifted toward a backing roller 3. Secured in clamping beam 2 in such a way that it can be released at its foot, is a doctor 4.

The point 5 of doctor 4 rests against backing roller 3. Below the point, a supporting strip 6 engages doctor 4 and is secured to doctor beam 1 in such a way that it can move back and forth more or less parallel to clamping beam 2. Supporting strip 6 extends over the operating width, and the side of the strip opposite the line of support is slotted at regular intervals and is accordingly flexible to a certain extent. Uniformly distributed setscrews 7 engage the same side and allow manual establishment of a locally variable pressure over the width of doctor 4.

Flexible clamping beam 2 can be locally shifted toward backing roller 3 by means of spindle-based thrusters 8 distributed at regular intervals (of approximately 50–100 mm) along the operating width. Each thruster 8 has for this purpose a drive mechanism 8.1 that is governed by unillustrated controls, which include a measuring instrument that determines the cross-section of the coating. The drive mechanism can also be engaged in order to vary all the spindle-based thrusters 8 together and establish the tension at the beginning of the coating process. Pneumatic or hydraulic mechanisms or thermally expanding structures, expansion rods for example, can be employed instead of spindle-based thrusters 8.

Figure 3:
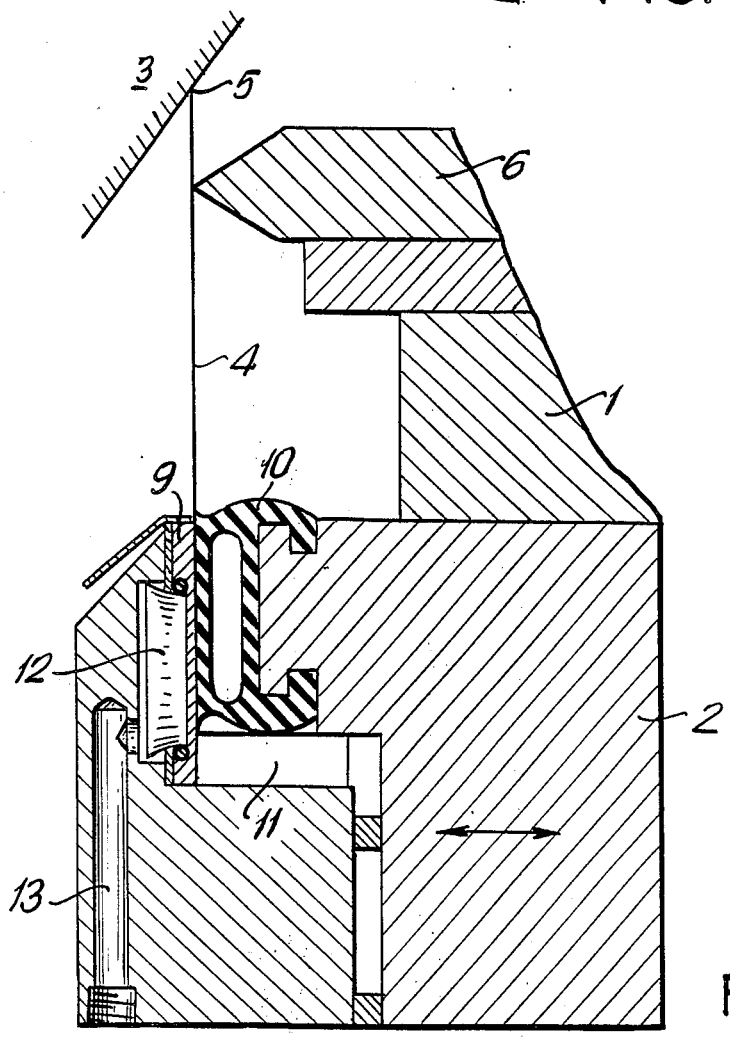
FIG. 3 is a section through a coating device with a mechanism for correcting the cross-section integrated into the clamping beam.

The mechanism that corrects the transverse cross-section of the coating in the embodiment illustrated in FIG. 3 is integrated into a clamping beam that can be shifted approximately 20 mm more or less horizontally. The foot of doctor 4 is for this purpose tensioned between the more or less vertical leg 9 of an angled strip and a counterpressure-generating hose 10 secured in clamping beam 2. The more or less horizontal leg 11 of the angled strip, which is positioned below a counterpressure-generating hose 10, has regularly spaced slots along the operating width at its end and terminates, when doctor 4 is tensioned in, at a certain distance away from clamping beam 2. This measure allows a more or less horizontal motion on the part of the foot of the doctor to a limited extent (approximately 3–4 mm) relative to clamping beam 2. This motion is generated by bellows 12 positioned adjacent to one another along the operating width with the side that faces away from doctor 4 resting against the vertical leg 9 of the angled strip. Since each bellows 12 has its own supply line 13 for air or liquid, the pressure in each bellows can be regulated individually. The counterpressure-generating hose 10 that extends over the operating width has a compressed-air supply line that generates a prescribed and constant counterpressure. Associated controls that regulate the distribution of pressure in bellows 12 in accordance with the cross-section of the coating are not illustrated in FIG. 3.

Figure 4:
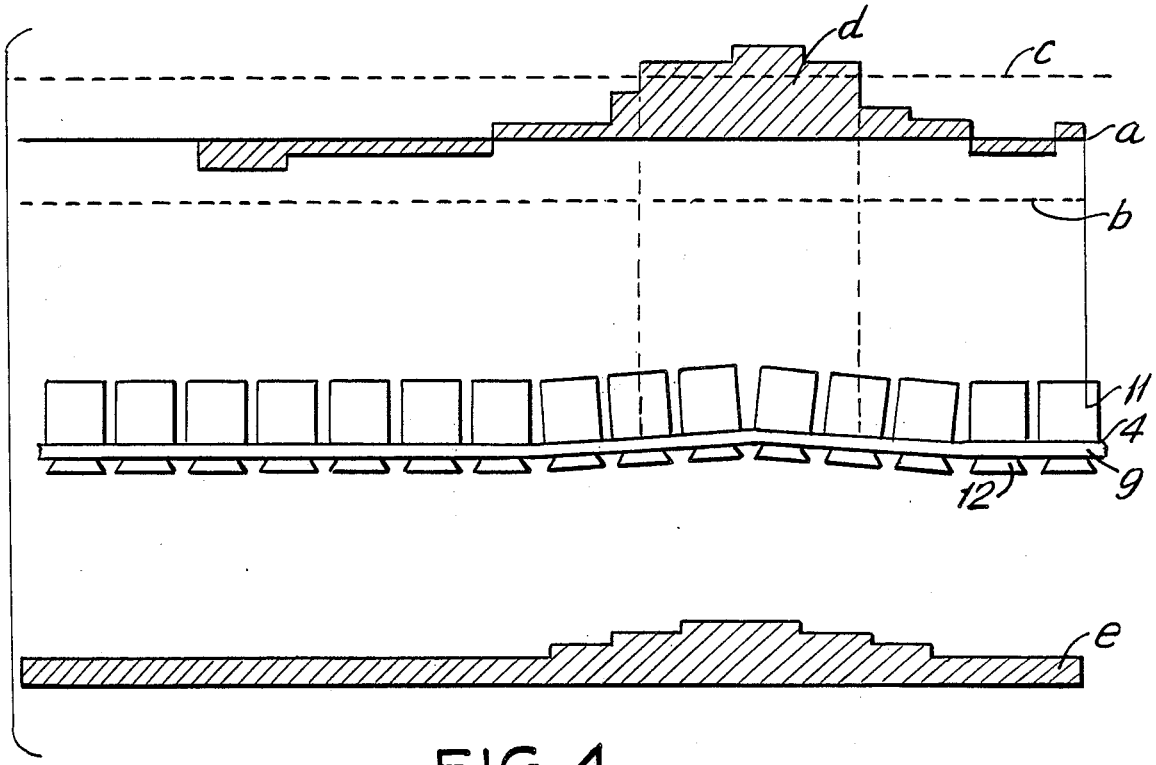
FIG. 4 is a schematic representation illustrating how the coating-density cross-section is corrected in the device illustrated in FIG. 3.

FIG. 4 illustrates how the device illustrated in FIG. 3 operates. The geometry and pressure of the point of the doctor is adjusted to the desired coating density at the beginning of the coating process (line a). The tension of doctor 4 that dictates the pressure is established by moving supporting strip 6 and clamping beam 2 toward each other in doctor beam 1. A uniform coating cross-section is attained by adjusting the setscrews 7 on supporting strip 6. A measuring instrument constantly measures the coating density at separate transverse areas of the web of paper during the coating process. The permissible range of coating density is demarcated by the lines b and c in FIG. 4. If the coating becomes too thick in one or more areas (area d), the controls will increase the pressure in the bellows 12 that act on doctor 4 in those areas. The increased pressure elastically deforms the tensioned section of doctor 4 toward counterpressure-generating hose 10 in these areas, decreasing the pressure on the point 5 of doctor 4 and accordingly reducing the thickness of the coating to the intended level. Region d represents the distribution of pressure in the individual bellows 12 that is necessary to compensate for the impermissibly thick coating in area b. The pressure in individual bellows 12 is similarly reduced when the coating in the associated areas is too thin.

The areas of clamping beam 2 in which the flow of coating is too high are shifted away from backing roller 3 by spindle-based thrusters 8. Since the foot of the doctor is secured immovably in flexible clamping beam 2, it is also adjusted, decreasing the coating density in the associated area.

Figure 5:
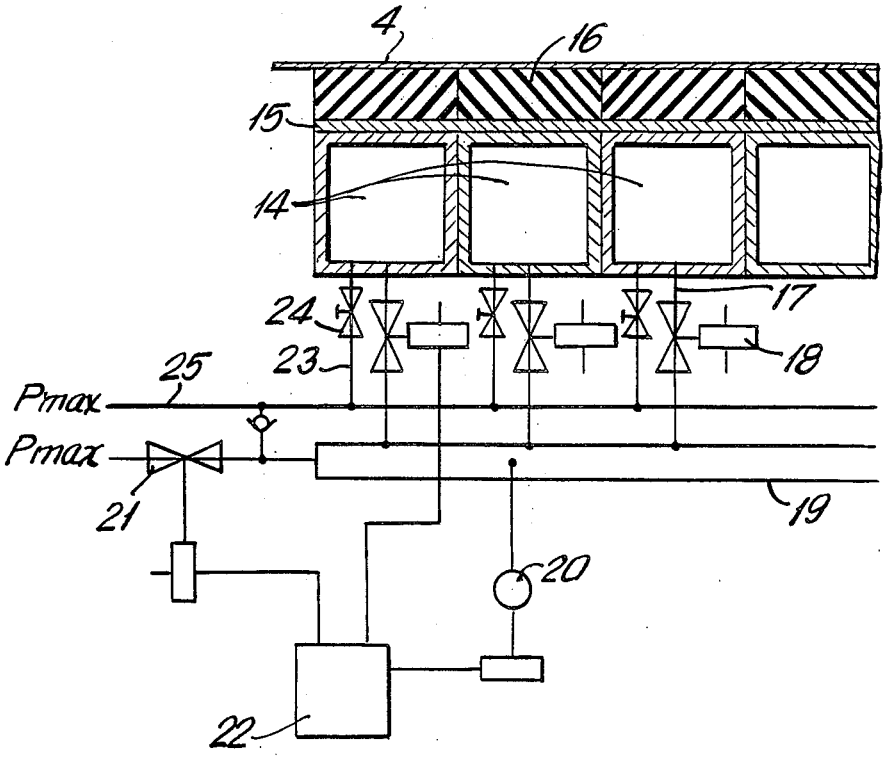
FIG. 5 is a schematic representation of a device with pressure-adjusting mechanisms in the form of pressurized chambers.

In the cross-section correction mechanism illustrated in FIG. 5, the individual areas of doctor 4 are adjusted by means of several adjacent pressurized chambers 14 distributed over the operating width. The wall 15 of each chamber that faces doctor 4 is elastic. Elastic walls 15 are attached to a resilient compensation strip 16 that rests against doctor 4.

Each pressurized chamber 14 has its own compressed-air supply line 17 with a regulating valve 18 that communicates with a joint distribution line 19. The pressure in distribution line 19 is regulated by a manometer 20 and a regulating valve 21. A computer 22 also controls the pressure in each individual pressurized chamber 14.

Ancillary compressed-air supply lines 23, each with its own manually operated valve 24 communicating with a joint distribution line 25, make it possible to adjust the pressure in each chamber 14 manually.

This system of correcting the cross-section of the coating is especially appropriate for re-equipping existing coating devices because it can be employed instead of a manually adjusted supporting strip. It is not necessary to change the design of clamping beam 2.

At the beginning of the coating process, pressure is generated in distribution line 19 to ensure sufficient pressure on the part of the point of the doctor. A mean pressure is established in each pressurized chamber 14 by way of regulating valves 18. Once the coating process is under way, computer 22 opens or closes the individual regulating valves in accordance with the detected cross-section of the coating. The computer simultaneously controls the pressure in distribution line 19 in accordance with the demand in each chamber 14.

The pressures in the separate pressurized chambers 14 are corrected at regular intervals, with the actual value of the pressure in one chamber being stored in the computer as a reference for the next correction.

It will be appreciated that the instant specifications and claims are set forth by way of illustration and not limitation, and that various modifications and changes may be made without departing from the spirit and scope of the present invention.

What is claimed is:

1. In a device for coating a web of material traveling around a backing roller, with a flexible doctor having a foot secured in a clamping beam, an edge for contacting a web on the backing roller and supported by a supporting bar and with pressure-adjusting mechanism positioned along the width of the doctor and acting independently of each other in individual positions on the doctor, the improvement wherein the supporting bar is in contact with the doctor below the edge and a portion of the pressure-adjusting mechanism disposed below the supporting bar to act on the doctor to adjusting the pressure of the doctor on the backing roller.

2. The device as in claim 1, wherein the clamping beam is flexible across the web of material and is subject to pressure-adjusting mechanisms that are separated along the operating width and can be activated independently.

3. The device as in claim 1 or 2, wherein the pressure-adjusting mechanisms comprise spindle-based thrusters.

4. The device as in claim 2, wherein the pressure-adjusting mechanisms are separately engaged in order to establish the tension on the doctor.

5. The device as in claim 1, wherein the doctor is secured in the clamping beam for movement towards the backing roller, and the position of individual areas of the doctor are adjusted independently in relation to the clamping beam by the mechanisms integrated into the clamping beam.

6. The device as in claim 5, wherein the doctor is secured in the clamping beam between a flexible strip that extends over the operating width and a resilient tensioning element and wherein the pressure-adjusting mechanisms comprise pneumatic or hydraulic mechanisms engaging the flexible strip.

7. The device as in claim 6, wherein the tensioning element comprises a hose that extends over the operating width and can be charged with air.

8. In a device for coating a web of material traveling around a backing roller, with a flexible doctor having a foot secured in a clamping beam and a point supported by a supporting strip and with pressure-adjusting mechanisms positioned above the width of the doctor and acting independently of each other on individual points on the doctor, the improvement wherein the pressure-adjusting mechanisms comprise several adjacent chambers that extend over the operating width and can be independently pressurized, each with an elastic wall that faces the doctor.

9. The device as in claim 8, wherein each pressurized chamber has a compressed-air supply line with an independently controlled valve that communicates with a joint distribution line that has its own pressure-regulation unit.

10. The device as in claim 8, further comprising a resilient compensation strip that rests against the doctor with the elastic wall of the pressurized chambers resting against a surface that faces away from the doctor.

11. The device as in claim 10, wherein the elastic walls rest against a supporting strip that constitutes the resilient compensation strip.

* * * * *